US009905094B1

(12) United States Patent
Hooper

(10) Patent No.: US 9,905,094 B1
(45) Date of Patent: Feb. 27, 2018

(54) STABILIZE AND STATUS ALERT DEVICE FOR A REFUSE CAN

(71) Applicant: Robert W. Hooper, Wanchese, NC (US)

(72) Inventor: Robert W. Hooper, Wanchese, NC (US)

( * ) Notice: Subject to any disclaimer, the term of this patent is extended or adjusted under 35 U.S.C. 154(b) by 0 days.

(21) Appl. No.: 15/236,939

(22) Filed: Aug. 15, 2016

Related U.S. Application Data

(60) Provisional application No. 62/205,015, filed on Aug. 14, 2015.

(51) Int. Cl.

| | |
|---|---|
| ***G08B 13/14*** | (2006.01) |
| ***B65F 1/16*** | (2006.01) |
| ***B65F 1/14*** | (2006.01) |
| ***B65D 25/22*** | (2006.01) |
| *B65D 25/20* | (2006.01) |

(52) U.S. Cl.
CPC ..... *G08B 13/14* (2013.01); *B65D 25/22* (2013.01); *B65F 1/141* (2013.01); *B65F 1/1473* (2013.01); *B65F 1/16* (2013.01); *B65D 25/20* (2013.01); *B65F 2210/128* (2013.01); *B65F 2210/168* (2013.01); *B65F 2210/172* (2013.01); *B65F 2210/184* (2013.01)

(58) Field of Classification Search
None
See application file for complete search history.

(56) References Cited

U.S. PATENT DOCUMENTS

| | | | | |
|---|---|---|---|---|
| 4,484,682 | A | 11/1984 | Crow | |
| 4,773,027 | A | 9/1988 | Neumann | |
| 4,872,582 | A | 10/1989 | Sipple | |
| 4,905,945 | A | 3/1990 | Peterson | |
| 5,067,686 | A | 11/1991 | Peterson | |
| 5,558,013 | A | 9/1996 | Blackstone, Jr. | |
| 5,897,018 | A | 4/1999 | Pruitt | |
| 6,687,656 | B2 | 2/2004 | Durbin et al. | |
| 6,786,349 | B2 * | 9/2004 | Najd | B65F 1/141 220/483 |
| 7,494,098 | B1 * | 2/2009 | Fulda | B65F 1/141 220/483 |
| 2005/0281653 | A1 * | 12/2005 | Channel | B60L 8/00 414/498 |
| 2013/0278067 | A1 | 10/2013 | Poss et al. | |
| 2013/0327775 | A1 * | 12/2013 | Diaz | B65F 1/122 220/315 |
| 2014/0076912 | A1 | 3/2014 | Mattingly | |
| 2014/0149265 | A1 | 5/2014 | Kundra | |
| 2015/0237750 | A1 * | 8/2015 | Yang | H05K 5/0234 206/45.2 |

FOREIGN PATENT DOCUMENTS

| | | | |
|---|---|---|---|
| CN | 203064590 | U | 7/2013 |
| WO | 2010034094 | A1 | 4/2010 |

* cited by examiner

*Primary Examiner* — Leon-Viet Nguyen
(74) *Attorney, Agent, or Firm* — Robert C. Montgomery; Montgomery Patent & Design

(57) ABSTRACT

A stabilizer and status alert device for a refuse can includes a base configured to support the refuse can in an upright position, a retaining feature configured to releasably couple the refuse can to the base, and an alert system configured to deliver a status notification to a user device in response to the refuse can be uncoupled from the base.

16 Claims, 4 Drawing Sheets

STABILIZE AND STATUS ALERT DEVICE FOR A REFUSE CAN

RELATED APPLICATIONS

The present invention claims the benefit of U.S. Provisional Application No. 62/205,015 filed on Aug. 14, 2015, the entire disclosures of which are incorporated herein by reference.

FIELD OF THE INVENTION

The present invention relates generally to refuse cans and, more particularly, to a stabilizer and status alert device for a refuse can.

BACKGROUND OF THE INVENTION

One (1) of the many chores that plague our everyday lives is the taking out of trash from wastebaskets and other sources commonly found in the American household. Most of the times such trash is placed into large trash cans located outside the home. While some homes have dedicated locations that protect trash cans from the environment, most trash cans are exposed to the elements and possibly to animals. Thus, under windy conditions or as a result of animal intrusion, trash cans are often blown or knocked over, which can scatter trash around the yard of the trash can owner and, potentially, neighboring yards as well. This presents a situation that is not only unsightly, but unsanitary as well. Additionally, even cans that are protected in a garage must spend time each week at the curb for trash collection, where they are exposed to the same problems.

Accordingly, there exists a need for a means to prevent or reduce the problems described above.

SUMMARY OF THE INVENTION

The inventor has recognized the aforementioned inherent problems and lack in the art and observed that there is a need for a device that protects refuse cans from being knocked over and, in the event the refuse can is knocked or blown over, notifies the owner of the can of the knocked over condition of the can. The development of the present invention, which will be described in greater detail herein, fulfills this need.

In one (1) embodiment, the disclosed stabilizer and status alert device for a refuse can includes a base configured to support the refuse can in an upright position, a retaining feature configured to releasably couple the refuse can to the base, and an alert system configured to deliver a status notification to a user device in response to the refuse can be uncoupled from the base.

In another embodiment, the disclosed device for a refuse can includes a refuse can including a bottom surface, a mounting plate connected to the bottom surface of refuse can, wherein the mounting plate is made of a ferromagnetic material, a base including a configured to support surface configured to contact the bottom surface of the refuse can and support the refuse can in an upright position, and a plurality of magnets connected to the base and configured to magnetically attach to the mounting plate to releasably couple the refuse can to the base.

In another embodiment, the disclosed device for a refuse can includes a refuse can including a bottom surface, a mounting plate connected to the bottom surface of refuse can, wherein the mounting plate is made of a ferromagnetic material, a base including a configured to support surface configured to contact the bottom surface of the refuse can and support the refuse can in an upright position, a plurality of magnets connected to the base and configured to magnetically attach to the mounting plate to releasably couple the refuse can to the base, and an alert system configured to deliver a status notification to a user device in response to the refuse can be uncoupled from the base, wherein the alert system includes at least one sensor configured to generate alarm signal in response to detecting a change in a condition of the refuse can, a processor electrically coupled to the at least one sensor, a transmitter electrically coupled to the processor, a power supply electrically coupled to the at least one sensor, the processor and the transmitter, and memory storing instructions, that when executed by the processor, causes the processor to set a baseline condition of the refuse can, interpret the alarm signal by comparing the condition to the baseline condition, generate an alert in response to the change in the condition, and wirelessly transmit the alert as the status notification to the user device.

In yet another embodiment, the disclosed method includes the steps of 1). releasably coupling a refuse can to a base in an upright position; 2). setting a baseline condition of the refuse can; 3). detecting a change in a condition of the refuse can; 4). generating an alarm signal in response to detecting the change in the condition; 5). interpreting the alarm signal by comparing the condition to the base condition; 6). generating an alert signal in response to the change in the condition; and 7). wirelessly transmitting the alert signal as a status notification to a user device.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
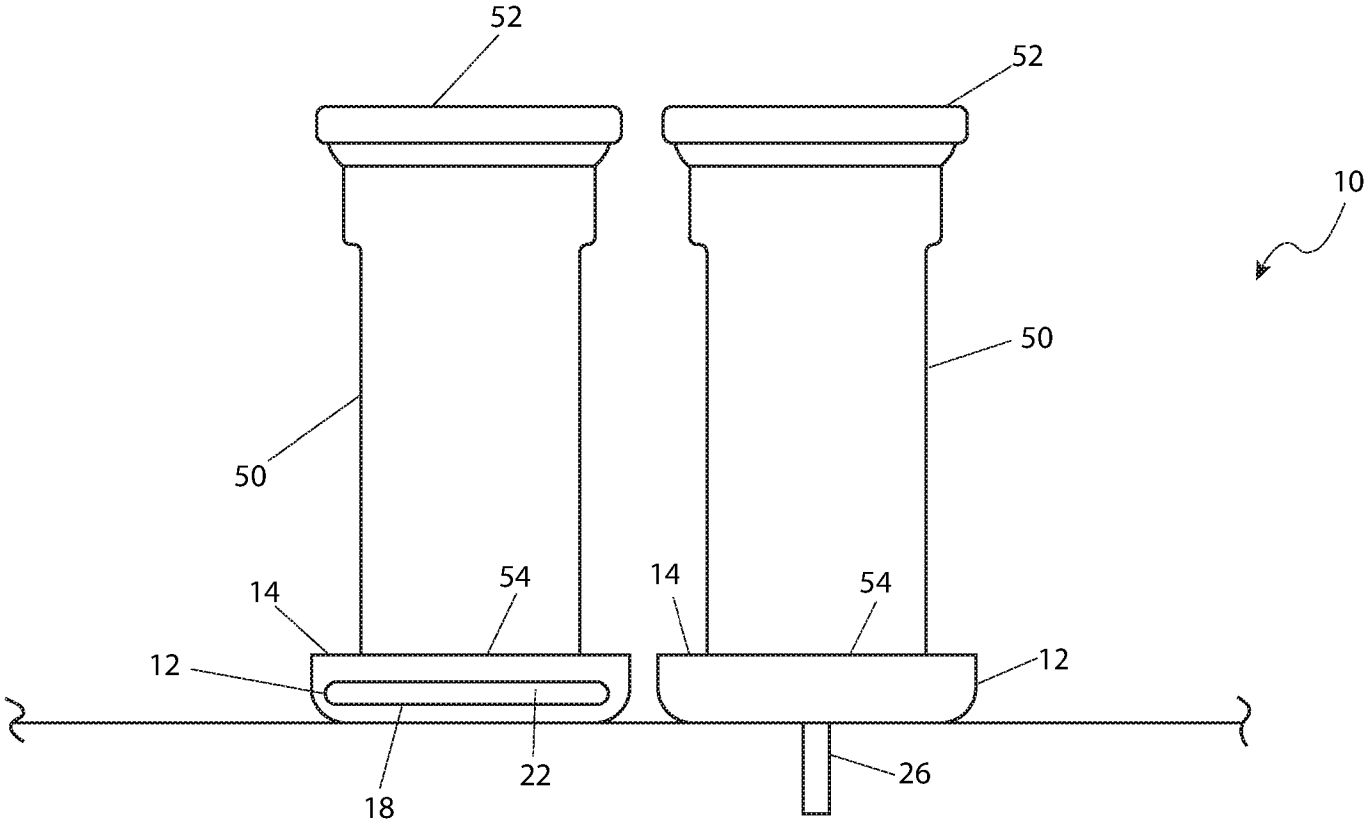
FIG. 1 is an environmental front view of a stabilizer and status alert device for a refuse can, according to an embodiment of the present invention.

10 stabilizer and status alert device
12 base
14 support surface
16 retaining feature

18 interior
20 magnet
22 weighting material
24 mounting plate
26 anchor
30 solar cell array
32 alert system
34 sensor
36 processor
38 memory
40 fill port
42 power supply
44 transceiver
46 antenna
50 refuse can
52 lid
54 refuse can bottom surface
56 user device
58 app
60 network
100 method

DETAILED DESCRIPTION OF THE PREFERRED EMBODIMENT

In accordance with the invention, the best mode is presented in terms of a preferred embodiment, herein depicted within FIGS. 1 through 4. However, the invention described herein is not limited to a single described embodiment and a person skilled in the art will appreciate that many other embodiments are possible without deviating from the basic concept of the disclosure and that any such work around will also fall under its scope.

Further, those skilled in the art will recognize that other styles and configurations can be incorporated into the teachings of the present disclosure, and that the example configurations shown and described herein are for the purpose of clarity and disclosure and not by way of limitation.

As used herein, the singular terms "a", "an", and "the" do not denote a limitation of quantity, but rather denote the presence of at least one (1), as well as a plurality of, the referenced items, unless the context clearly indicates otherwise.

Figure 2:
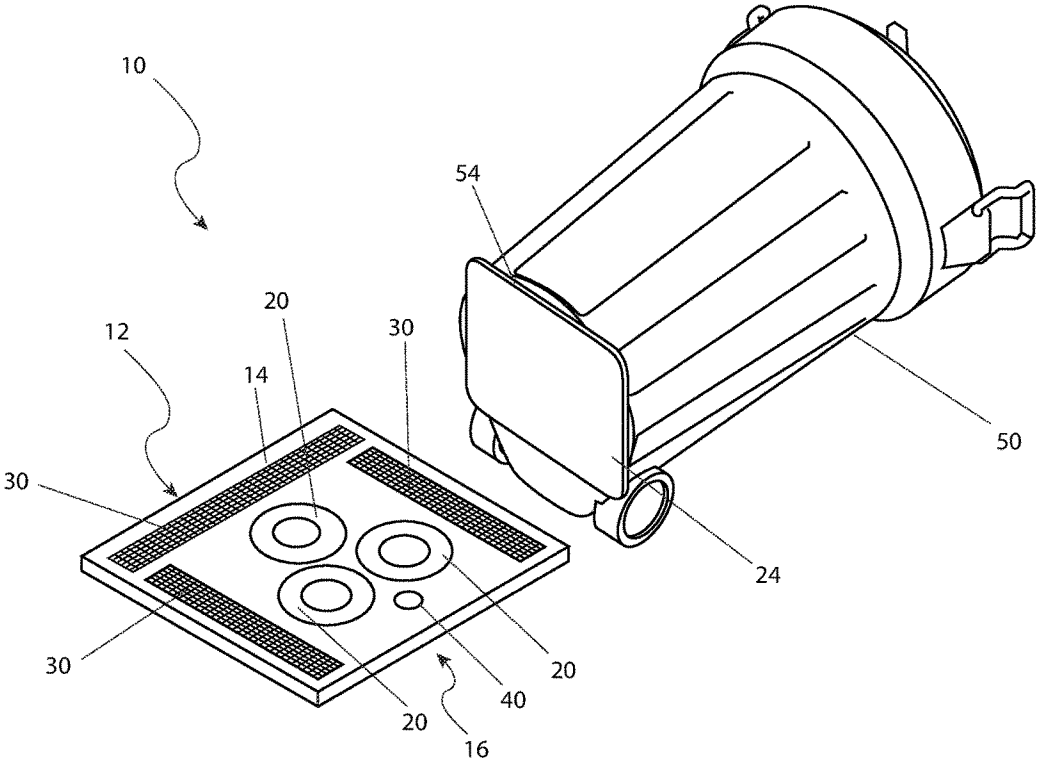
FIG. 2 is an environmental top perspective view of the stabilizer and status alert device for a refuse can, according to an embodiment of the present invention.
Figure 3:
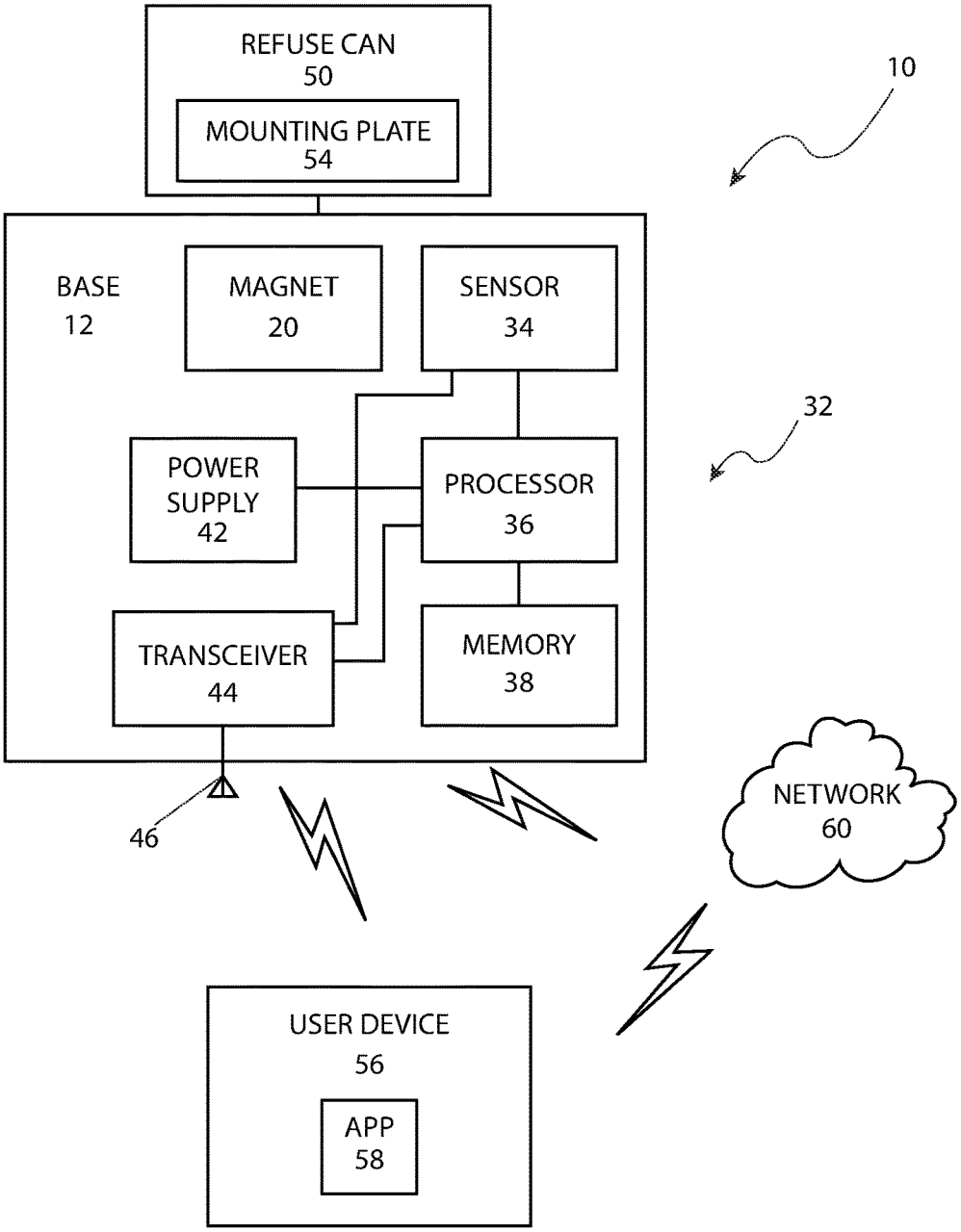
FIG. 3 is a schematic block diagram of a wireless communications environment in which the stabilizer and status alert device for a refuse can operates, according to an embodiment of the present invention; and, FIG. 4 is a flow diagram of a method for alerting a user of the status of a refuse can, according to an embodiment of the present invention.
Figure 4:
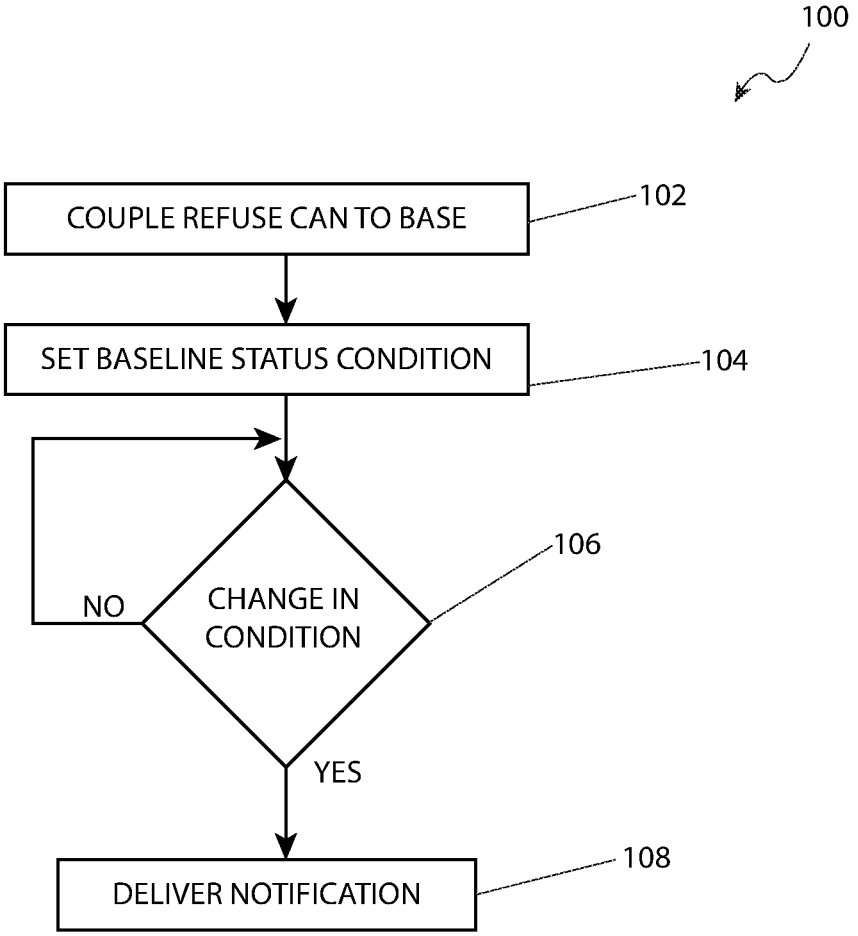

Referring to FIGS. 1-3, disclosed herein is a refuse can stabilizer and status alert device, herein referred to as a device 10, where like reference numerals represent similar or like parts. Referring to FIG. 4, also disclosed herein is a method for stabilizing and alerting the status of a refuse can, herein referred to as a method 100. Embodiments of the disclosed device 10 and method 100 provide a means to stabilize a refuse can 50 in order to maintain the refuse can 50 in a desired upright position and location and prevent the refuse can from being knocked over when empty or full. Embodiments of the disclosed device 10 and method 100 further provide a means to monitor the status of the refuse can 50, for example, when the refuse can 50 has been moved, emptied or otherwise uncoupled from the base 12, and alert the user of the status of the refuse can 50.

FIG. 2 is an environmental front view of the disclosed device 10, according to a preferred embodiment. The device 10 includes a base 12. The base 12 is configured to be coupled to and support and retain at least one (1) refuse can 50. In other embodiments, the device 10 also includes the refuse can 50.

In the various embodiments of the disclosed device 10, the refuse can 50 includes any waste receptacle, such as a container or bin used to accommodate trash, recyclables, green waste and the like. As an example, the refuse can 50 is a large bin, such as those used for residential trash and recycling collection by a waste management organization. In some example, the refuse can 50 includes a removal lid 52. In some examples, the refuse can 50 includes two (2) or more wheels.

The base 12 is configured to be placed on any ground support surface, for example, outdoors, such as on the ground, near a curb, on a driveway and the like. The base 12 is configured to support and retain the refuse can 50 in the upright position. In one (1) example implantation of use, the base 12 may be placed in a suitable location for trash collection purposes, for example, near a curb or other collection location. In another example implementation of use, the base 12 may be placed in any outdoor location where the refuse can 50 may be located for any length of time.

As an example, and as illustrated in FIG. 1, the base 12 may be configured to support and retain one (1) refuse can 50. As another example (not shown), the base 12 may be configured to support and retain more than one (1) refuse can 50. In either example, the base 12 suitably spaces multiple refuse cans 50 apart, for example, for trash collection.

In an example, the base 12 is made of a durable plastic material. As an example, the base 12 may be made of acrylonitrile butadiene styrene (ABS) plastic. In one (1) example construction, the plastic used to make the base 12 contains at least a portion of recycled content, thus making the disclosed device 10 an environmentally friendly option for the consumer.

The base 12 includes dimensions suitable to prevent the coupled refuse can 50 from flipping the base 12. As an example, the base 12, whether a single base 12 configured to support multiple refuse cans 50 or a plurality of bases 12 each configured to support one (1) refuse can 50, may also include dimensions suitable to space multiple refuse cans 50 apart a sufficient distance to allow for manual or machine (e.g., garbage truck) removal of the refuse can 50 from the base 12 for emptying and/or trash collection. As an example construction, the dimensions of the base 12 include approximately thirty inches (30 in.) wide, approximately thirty inches (30 in.) deep, and approximately six inches (6 in.) high. In other examples, different dimensions may also be used.

In an example embodiment, the base 12 is configured to be placed as desired and remain firmly in place on the ground support surface, for example, when placed at a desired location for supporting the refuse can 50. As examples, the base 12 would be placed at or near the curb for garbage pickup and/or placed near the home where the refuse cans 100 are regularly stored between collection.

In an example construction, the base 12 is formed by a plurality of walls or sides, such as one (1) or more of a top side or wall, a bottom side or wall, a front side or wall, a back side or wall, a left side or wall and/or a right side or wall. In different example constructions, one or more of the sides or walls may be omitted. As an example, in certain embodiments, the base 12 does not include the bottom side or wall.

As one (1) example of this embodiment, the base 12, for example, formed by the one (1) or more sides or walls, includes a hollow interior 18. The interior 18 may be filled with a weighting material 22. As an example implementation of this embodiment, the hollow interior 18 of the base 12 may be configured to be filled with the weighting material 22, for example, by the end user. In such an example, the base 12 includes a fill port 40 disposed through the support surface 14 that provides access to the interior 18 of the base 12. In this example, the base 12 also includes a removable cap or cover (not shown) to cover the fill port 40 and completely enclose the interior 18. As another example implementation of this embodiment, interior 18 of the base 12 may be prefilled with the weighting material 22, for example, by the manufacturer.

In either of the example implementation, the weighting material 22 includes a mass (e.g., a weight) greater than the expected weight of the refuse can 50 when filled with trash, recyclables, green waste and the like in order to prevent the refuse can 50 from flipping the base 12 over. As examples, the weighting material 22 may include water, sand, dirt, rocks, concrete, gravel, combinations thereof, or any other material having a relatively high mass (e.g., large weight) relative to size or volume.

In another example of this embodiment, the base 12 includes at least one (1) anchor 26. The anchor 26 is configured to secure (e.g., couple) the base 12 to the ground support surface. In an example, and as illustrated in FIG. 1, the anchor 26 is connected, for example, rigidly connected to an underside (e.g., bottom) surface of the base 12 and extends downwardly to penetrate the ground support surface. As examples, the anchor 26 may include a pigtail anchor, a spike, and the like. In another example (not shown), a plurality of anchors 26 is connected to the top and/or side surfaces of the base 12 and extends outwardly for attachment to an external fastener, tie, spike, or the like.

In yet another example, the base 12 includes a combination of both the interior 18 filled with the weighting material 22 and the anchor 26. The choice between the weighting material 22, the anchor 26, or the weighting material 22 and the anchor 26 may depend on various factors including the type of ground surface upon which the base 12 rests (e.g., dirt, concrete, asphalt, etc.) and/or the expected overall combined weight of the refuse can 50 and a full load of trash within the refuse can 50.

In another example embodiment, the base 12 is integrated within the ground surface, for example, buried underground or formed within a driveway at or near the curb for garbage pickup and/or placed near the home where the refuse cans 100 are regularly stored between collection. In this example embodiment, the weighting material 22 and/or anchor 26 may be unnecessary.

FIG. 2 is an environmental top perspective view of the disclosed device 10, according to a preferred embodiment. The base 12 includes a support surface 14 configured to support a refuse can 50 in the upright position. As an example, a refuse can bottom surface 54 may make contact with and rest upon the support surface 14. In the preferred embodiment, the support surface 14 defines at least a portion of a top surface of the base 12.

The base 12 also includes a retaining feature 16 configured to retain the refuse can 50 in the upright position. The retaining feature 16 is configured to releasably couple the refuse can 50 to the base 12. As an example, the retaining feature 16 is configured to engage the refuse can bottom surface 54.

In the preferred embodiment, the retaining feature 16 includes at least one (1) magnet 20. As an example, the magnet 20 or plurality of magnets 20 is a permanent magnet. As another example, the magnet 20 or plurality of magnets 20 is an electromagnet. In one (1) example construction, the magnets used as the magnets 20 of the retaining feature 16 includes least a portion of recycled content (e.g., recycled speaker magnets), thus making the disclosed device 10 an environmentally friendly option for the consumer.

As an example, and as illustrated in FIG. 2, the retaining feature 16 includes three (3) magnets 20. In other examples (not shown), the retaining feature 16 may include any other number (e.g., one (1), two (2), four (4), etc.) of magnets 20.

In this embodiment, the device 10 also includes a mounting plate 24. The mounting plate 24 is made of a ferromagnetic material that is attracted to the magnet 20. Thus, in this example, the refuse can 50 is magnetically attached to the base 12.

Depending upon the embodiment, the mounting plate 24 may be installed on an existing refuse can or may be a part of a refuse can manufactured for use with the device 10. In one (1) example, and as illustrated in FIG. 2, the mounting plate 24 is attached to an underside of the refuse can bottom surface 54, for example, by mechanical fasteners, adhesives, or any other suitable fastening mechanism. In another example (not shown), the mounting plate 24 is integrated into the refuse can bottom surface 54, for example, during manufacture of the refuse can 50.

Embodiments of the device 10 may include magnets 20 having different sizes, strengths, and positional configuration relative to the base 12. As an example, when a single magnet 20 is used, a larger and/or stronger magnet 20 may be used. As an example, when a single magnet 20 a relatively large magnet 20 may be suitably sized to cover a sufficient portion of the refuse can bottom surface 54 or mounting plate 24 to prevent the refuse can 50 from being knocked over. Alternatively, as another example, a relatively strong magnet 20 may be of sufficient strength to prevent the refuse can 50 from being knocked over. In an example construction, a single large and/or strong magnet 20 may be positioned approximately in the center of the base 12.

As another example, when a plurality of magnets 20 is used, smaller and/or weaker magnets 20 may be used. As an example, a sufficient plurality of smaller magnets 20 may be suitably sized and/or collectively be arranged (e.g., in a triangular arrangement, a circular arrangement, a radial arrangement, etc.) to cover a sufficient portion of the refuse can bottom surface 54 or mounting plate 24 to prevent the refuse can 50 from being knocked over. Alternatively, as another example, a plurality of weaker magnets 20 may collectively be of sufficient strength to prevent the refuse can 50 from being knocked over. In an example construction, and as illustrated in FIG. 2, a plurality of (e.g., three (3)) magnets 20 may be positioned approximately in the center of the base 12 and/or arranged in any geometric configuration extending outwardly from the center to perimeter edges of the base 12.

In the preferred embodiment, the magnet 20 or plurality of magnets 20 is positioned flush with or just underneath the support surface 14 of the base 12 in order to allow the magnets 20 to be capable of magnetically mating with the magnetic mounting plate 24 that is attached to or otherwise integral with the refuse can bottom surface 54. The base 12 has a low profile design to allow a lawn mower to pass over the base 12 without damaging the device 10.

While the illustrated embodiment depicts the retaining feature 16 as one (1) or more magnets 20, in other embodiments, different types of retaining features 16 may be used. As an example, the retaining feature 16 may include one (1) or more releasable clips or clamps or similar mechanical retaining mechanism.

These features provide several benefits and/or advantages. First, the magnets 20 prevent high winds from blowing over and/or animals from knocking over empty or full refuse cans 100, thus keeping the user's yard, street and neighborhood clean. Second, in the case of multiple refuse cans 100, multiple bases 12 ensure that multiple refuse cans 100 are properly spaced at the curbside pickup point in order to ensure that the automated pickup arms of garbage trucks can properly operate Finally, the mounting plate 24, when attached to the underside surface of the refuse can bottom surface 54 prevents scuffing damage to the bottom of the refuse can 50.

In the various embodiments, the base 12 can be personalized or customized to enhance its appeal. As an example, the base 12 may be discreetly colored to blend in with the user's yard or curbside location. As another example, the base 12 may include colors, words, phrases, logos and the like associated with various interests of the user.

While the device 10 (e.g., the retaining feature 16) is intended and designed to prevent the refuse can 50 from being unintentionally uncoupled from the base 12, for example, when knocked or blown over, in certain conditions and in response to certain events, the refuse can 50 may still become uncoupled from the base 12.

FIG. 3 is a schematic block diagram of the disclosed device 10, according to a preferred embodiment. The device 10 also includes an alert system 32 configured to notify the user regarding the status of the refuse can 50. As an example, the alert system 32 may notify the user that the refuse can 50 is no longer in contact with the base 12, for example, that the refuse can 50 has been knocked or blown over. As another example, the alert system 32 may notify the user that trash collection has been completed and the refuse can 50 has been emptied and is ready to be returned to its stored location.

As illustrated in FIG. 3, the device 10 and, particularly, the alert system 32 operates in wireless communication environment. The device 10 (e.g., the alert system 32 of the device 10) includes at least one (1) sensor 34, a processor 36, memory 38, a transceiver 44 and an antenna 46. The sensor 34, the processor 36, the memory 38 and the transceiver 44 are disposed within or otherwise attached to the base 12.

The sensor 34 is configured to detect different status conditions of the refuse can 50. The sensor 34 is coupled to the processor 36. Upon the sensor 34 detecting one or more predetermined status conditions of the refuse can 50, an alarm signal is transmitted to and processed by the processor 36. In response to the alarm signal, an alert signal is transmitted to the transceiver 44, which then transmits and delivers the alert signal or status notification to a user device 56.

Generally, the sensor 34 is any device configured to detect changes in and/or capture data from its environment. As an example, the sensor 34 may detect that the refuse can 50 has been uncoupled (e.g., removed) from the base 12. In this example, the sensor 34 may include a light (e.g., IR) sensor, a motion sensor, a proximity sensor, a pressure sensor and the like. As another example, the sensor 34 may detect a change in the weight of the refuse can 50, for example, before and after trash collection. In this example, the sensor 34 may include a weight sensor.

The processor 36 includes decision logic configured to interpret various different alarm signals generated by the sensor 34. The memory 38 includes instructions stored thereon that, when executed by the processor, causes the processor to determine the status condition of the refuse can 50 and determine whether to transmit the alert (e.g., deliver the notification) to the user device 56 based on the input signals from the sensor 34. Various different alarm signals based on the status condition of the refuse can 50 and the associated alerts are also stored on the memory 38.

The transceiver 44 includes any suitable radio frequency (RF) transmission device configured to wirelessly transmit and/or receive data. As an example, the transceiver 44 includes a digital or analog transmitter and/or receiver.

Communication between the device 10 (e.g., the alert system 32) and the user device 56 may be established through various mediums. In an example, the alert system 32 is configured to deliver the alert or status notification directly to the user device 56, for example, using a cellular telephone network), such as in the form of a text message. In another example, the alert system 32 is configured to deliver the alert or status notification to the user device 56 over a network 60, for example, using a wireless local area network (WLAN) such as a local Wi-Fi network, such as in the form of a notification from the app 58 or delivery of an email.

The user device 56 may include any wireless user terminal capable of transmitting and/or receiving wireless transmissions of data. Examples of the user device 56 include a smartphone, a tablet, a personal computer, and the like. In certain embodiments, the user device 56 may include a dedicated application, or app 58, for receiving and processing the alert signal from the alert system 32 and displaying the status notification to the user.

In an example embodiment, the processor 36 may be preprogrammed with responses to alarm signals from the sensor 34. In another example embodiment, the processor 36 may be programmed locally or accessed remotely to enter preferences and other user settings. As an example, the user may enter their preferences any number of ways, including through a graphical user interface over the Internet, via the user device 56 (e.g., a smartphone or tablet), and/or other electronic means.

Non-limiting examples of preprogrammed alarm inducing status conditions and responses and/or user preferences may include: 1). if the refuse can 50 is instantaneously uncoupled from the base 12; 2). if the weight of the refuse can 50 changes; 3). if the refuse can 50 has remained uncoupled from the base 12 for a predetermined period of time; 4). the type of alert notification received by the user device 56 based on the associate alarm signal; 5). whether or not the notification is delivered and/or displayed to the user device 56 based on the they type of alarm signal, and the like.

In the preferred embodiment, the device 10 also includes a power supply 42 configured to provide operational power to the alert system 32. In examples of the device 10 that utilize an electromagnet, the power supply 42 also provides operational power to the magnet 20. As an example, and as illustrated in FIG. 2, the power supply 42 includes a solar cell array 30.

In an example, the solar cell array 30 is disposed on the support surface 14 (e.g., the top surface) of the base 12. The solar cell array 30 is arranged at or near a perimeter of the base 12 outside of the area that supports the refuse can 50. The solar cell array 30 include a plurality of photovoltaic cells.

The solar cell array 30 is configured to convert solar radiation into electricity. In an example, the solar cell array 30 directly powers the alert system 32. In another example, the solar cell array 30 charges a rechargeable battery (not shown) disposed within the base 12. In this example, the power supply 42 also includes the rechargeable battery and associated charging and power inverting electronics and components.

Accordingly, use of the disclosed device 10 allows the user to securely support and retain refuse cans to prevent them from being blown and/or knocked over and their contents from being scattered around the yard and/or street. Further, use of the disclosed device 10 allows the user to receive status notifications or alerts related to the condition of the refuse can 50.

FIG. 4 is a flow diagram of the method 100 for alerting a user of the status of the refuse can 50. First the refuse can 50 is coupled (e.g., magnetically) to the base 12 (step 102). Next, the alert system 32, example, based on preprogrammed or user defined preferences, sets a baseline status condition for the refuse can 50 (step 104). For example, the baseline status condition may include the position of the refuse can 50, the weight of the refuse can 50, and the like.

Next, the sensor 34 monitors for (e.g., determines whether) a change in condition of the refuse can 50, (e.g., determines whether a change in the condition of the refuse can 50 has occurred) (step 106). As described above, non-limiting examples of a change in condition of the refuse can 50 may include a change in position of the refuse can 50, movement of the refuse can 50, the refuse can 50 being uncoupled from the base 12, a change in the weight of the refuse can 50, and the like.

When (e.g., if) the alert system 32 (e.g., the sensor 34) detects a change in condition of the refuse can 50 (e.g., step 106), the alert signal or status notification is transmitted and delivered to the user device 56 (step 108). As examples, the alert of a change in condition may be delivered as a text message, a status notification from the app 58, an email, and the like.

Accordingly, use of the disclosed device 10 and method 100 may notify the user (e.g., the homeowner) when the refuse can 50 has been emptied (e.g., trash collection has occurred), whether the refuse can 50 has been tampered with (e.g., moved, knocked over, etc.). The disclosed device 10 and method 100 may also provide the user with pattern information, such as the approximate time of regular trach collection or the time in which nuisance animal activity regularly occurs that tampers with the refuse can 50.

The materials required to produce the device 10 are all readily available and well known to manufacturers of goods of this type. In an example construction, the base 10 may be made of plastic and/or recycled plastic in an injection molding process. Such a process would require the design and use of custom molds. The magnets 20, metal mounting plates 24, the sensor 34, the processor 36, the memory 38, the power supply 42, the antenna 44, other electronic components of the alert system 32, fasteners, adhesive, and the like, would best be procured from manufacturers and wholesalers that deal in goods of that nature and assembled at a final location. The relatively simple design of the device 10 and the material of construction make the device 10 a cost-effective design due to the relatively low material and labor costs involved. Final production of the device 10 will be performed by manufacturing workers of average skill.

While the present invention has been described in the context of a fully functioning data processing system, those of ordinary skill in the art will appreciate that the processes of the present invention are capable of being distributed in the form of a computer readable medium of instructions and a variety of forms and that the present invention applies equally regardless of the particular type of signal bearing media actually used to carry out the distribution. Examples of computer readable media include recordable-type media, such as a floppy disk, a hard disk drive, a RAM, CD-ROMs, DVD-ROMs, and transmission-type media, such as digital and analog communications links, wired or wireless communications links using transmission forms, such as, for example, radio frequency and light wave transmissions. The computer readable media may take the form of coded formats that are decoded for actual use in a particular data processing system.

Those skilled in the art will recognize that other styles and configurations of the disclosed apparatus 10 can be easily incorporated into the teachings of the present disclosure, and only particular configurations have been shown and described for purposes of clarity and disclosure and not by way of limitation of scope.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

What is claimed is:

1. A stabilizer and status alert device for a refuse can, said device comprising:

a mounting plate connected to a bottom surface of said refuse can, wherein said mounting plate is made of a ferromagnetic material;

a base configured to support said refuse can in an upright position, said base comprising a support surface configured to contact said mounting plate;

three magnets connected to said base at said support surface and configured to magnetically engage said mounting plate to releasably couple said refuse can to said base, wherein said three magnets are arranged to form three vertices of a triangular shape on said support surface to enable three triangularly arranged points of magnetic engagement with said mounting plate; and, an alert system configured to deliver a status notification to a user device in response to said refuse can being uncoupled from said base, comprising:

a sensor configured to detect a change in a condition of said refuse can;

a processor configured to generate an alert based on said change in said condition; and, a transmitter configured to wirelessly transmit said alert as said status notification to said user device.

2. The device of claim 1, wherein said magnets comprise a permanent magnet.

3. The device of claim 1, wherein said magnets comprise an electromagnet.

4. The device of claim 1, wherein said magnets are disposed within said base and positioned flush with said support surface.

5. The device of claim 1, wherein said base defines a hollow interior and comprises a weighting material disposed within said interior and configured to maintain said base in contact with a ground support surface.

6. The device of claim 1, wherein said base comprises a downwardly extending anchor configured to maintain said base in contact with a ground support surface.

7. The device of claim 1, further comprising said refuse can.

8. The device of claim 1, wherein said sensor is a weight sensor, and said condition is a weight of said refuse can.

9. The device of claim 1, wherein said sensor is an IR sensor, and said condition is a position of said refuse can relative to said base.

10. The device of claim 1, further comprising a solar cell array configured to generate and deliver power to said alert system.

11. The device of claim 1, wherein said sensor is a motion sensor, and said condition is a position of said refuse can relative to said base.

12. The device of claim 1, wherein said sensor is a proximity sensor, and said condition is a position of said refuse can relative to said base.

13. The device of claim 1, wherein said sensor is a pressure sensor, and said condition is contact of said refuse can with said base.

14. A stabilizer and status alert device, said device comprising:

a refuse can comprising a bottom surface;

a mounting plate connected to said bottom surface of said refuse can, wherein said mounting plate is made of a ferromagnetic material;

a base configured to support said refuse can in an upright position, said base comprising a support surface configured to contact said mounting plate;

three magnets connected to said base at said support surface and configured to magnetically engage said mounting plate to releasably couple said refuse can to said base, wherein said three magnets are arranged to form three vertices of a triangular shape on said support surface to enable three triangularly arranged points of magnetic engagement with said mounting plate; and, an alert system configured to deliver a status notification to a user device in response to said refuse can being uncoupled from said base, comprising:

at least one sensor configured to generate an alarm signal in response to detecting a change in a condition of said refuse can;

a processor electrically coupled to said at least one sensor;

a transmitter electrically coupled to said processor;

a power supply electrically coupled to said at least one sensor, said processor and said transmitter; and, memory storing instructions, that when executed by said processor, causes said processor to:

set a baseline condition of said refuse can;

interpret said alarm signal by comparing said condition to said baseline condition;

generate an alert in response to said change in said condition; and, wirelessly transmit said alert as said status notification to said user device.

15. The device of claim 14, wherein said at least one sensor is one of a weight sensor, an IR sensor, a motion sensor, a proximity sensor and a pressure sensor.

16. The device of claim 14, wherein said power supply comprises a solar cell array.

* * * * *